US008568172B1

(12) United States Patent
Lan et al.

(10) Patent No.: US 8,568,172 B1
(45) Date of Patent: Oct. 29, 2013

(54) ELECTRICAL CONNECTOR

(75) Inventors: Rong-Qin Lan, Guang-Dong (CN); Li-Jun Xu, Guang-Dong (CN); Ming-Han Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 23 days.

(21) Appl. No.: 13/445,807

(22) Filed: Apr. 12, 2012

(51) Int. Cl.
*H01R 13/648* (2006.01)

(52) U.S. Cl.
USPC ..... 439/607.4

(58) Field of Classification Search
USPC ..... 439/63, 74, 79, 607.4, 660
See application file for complete search history.

(56) References Cited

U.S. PATENT DOCUMENTS 4,708,415 A * 11/1987 White ..... 439/633
4,717,218 A * 1/1988 Ratcliff ..... 439/59
5,478,258 A * 12/1995 Wang ..... 439/581
5,702,271 A * 12/1997 Steinman ..... 439/676
5,947,771 A * 9/1999 Bethurum ..... 439/668
6,095,865 A * 8/2000 Wu ..... 439/607.01
6,129,562 A * 10/2000 Hong ..... 439/79
6,238,249 B1 * 5/2001 Kuwamura ..... 439/668
6,752,662 B2 * 6/2004 Okamoto ..... 439/607.04
6,988,912 B2 * 1/2006 Bourgeas et al. ..... 439/581
7,883,369 B1 * 2/2011 Sun et al. ..... 439/607.35
8,272,897 B1 * 9/2012 Lin ..... 439/607.4
8,323,057 B2 * 12/2012 Ho ..... 439/660

* cited by examiner

*Primary Examiner* — Neil Abrams
*Assistant Examiner* — Phuongchi T Nguyen
(74) *Attorney, Agent, or Firm* — Cheng-Ju Chiang

(57) ABSTRACT

An electrical connector includes a first insulating housing having a base board and a tongue board extending forwards from a front of the base board. Two opposite sides of the base board extend downward to form a pair of clamping boards spaced from each other. A second insulating housing is assembled to the first insulating housing. The second insulating housing has a base portion resisting against rear edges of the clamping boards. A tongue portion protrudes forwards from a front of the base portion to be clamped between the clamping boards. A terminal group includes a plurality of flat terminals and a plurality of spring terminals. The flat terminals are molded in the first insulating housing and the spring terminals are molded in the second insulating housing. A metal shell encloses both the first insulating housing and the second insulating housing.

10 Claims, 4 Drawing Sheets

ELECTRICAL CONNECTOR

BACKGROUND OF THE INVENTION

1. Field of the Invention

The present invention relates to an electrical connector, and more particularly to an electrical connector capable of improving the soldering between terminals thereof and a circuit board.

2. The Related Art

A traditional electrical connector generally includes an insulating housing, a terminal group and a shielding shell. The insulating housing has a base body and a tongue portion protruding forward from a middle of a front of the base body. Top and bottom of the tongue portion define a plurality of first terminal grooves and second terminal grooves. Each terminal groove penetrates rearward through the base body. The terminal group includes a plurality of flat terminals and a plurality of spring terminals. The flat terminals are molded in the first terminal grooves and the spring terminals are molded in the second terminal grooves. The shielding shell encloses the insulating housing. However, the flat terminals and the spring terminals are molded in the insulating housing in a manner of double-row layout. As a result, it often affects the process of soldering the terminals with a circuit board, and even affects a wiring layout of the circuit board.

SUMMARY OF THE INVENTION

An object of the present invention is to provide an electrical connector adapted for connecting with a circuit board. The electrical connector includes a first insulating housing having a base board and a tongue board extending forwards from a front of the base board. Two opposite sides of the base board extend downward to form a pair of clamping boards spaced from each other. A second insulating housing is assembled to the first insulating housing. The second insulating housing has a base portion resisting against rear edges of the clamping boards. A tongue portion protrudes forwards from a front of the base portion to be clamped between the clamping boards. A terminal group includes a plurality of flat terminals and a plurality of spring terminals. Each flat terminal has a first fastening strip, a first contact portion and a first soldering tail connected with a front end and a rear end of the first fastening strip in a step manner respectively. The first fastening strips are molded in the base board and the tongue board of the first insulating housing. The first contact portions are exposed in a front of a bottom of the tongue board. The first soldering tails project behind the first insulating housing. Each spring terminal has a second fastening strip. A second contact portion curves upward and then slantwise extends forward from a front end of the second fastening strip with a free end thereof arched downward. A second soldering tail bends upward and then extends rearward from a rear end of the second fastening strip. The second fastening strips are molded in the second insulating housing. The second contact portions elastically project out of the bottom of the tongue board and are located behind the first contact portions. The second soldering tails project behind the first insulating housing and are aligned with the first soldering tails alternately in line to make the soldering tails of the terminal group show a single-row layout for being soldered with the circuit board. A metal shell encloses both the first insulating housing and the second insulating housing.

As described above, the second soldering tails of the spring terminals project behind the first insulating housing and are aligned with the first soldering tails of the flat terminals alternately in line to make the soldering tails of the terminal group show a single-row layout, so it is convenience to solder the soldering tails with the circuit board and further advantageous for a wiring layout of the circuit board.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
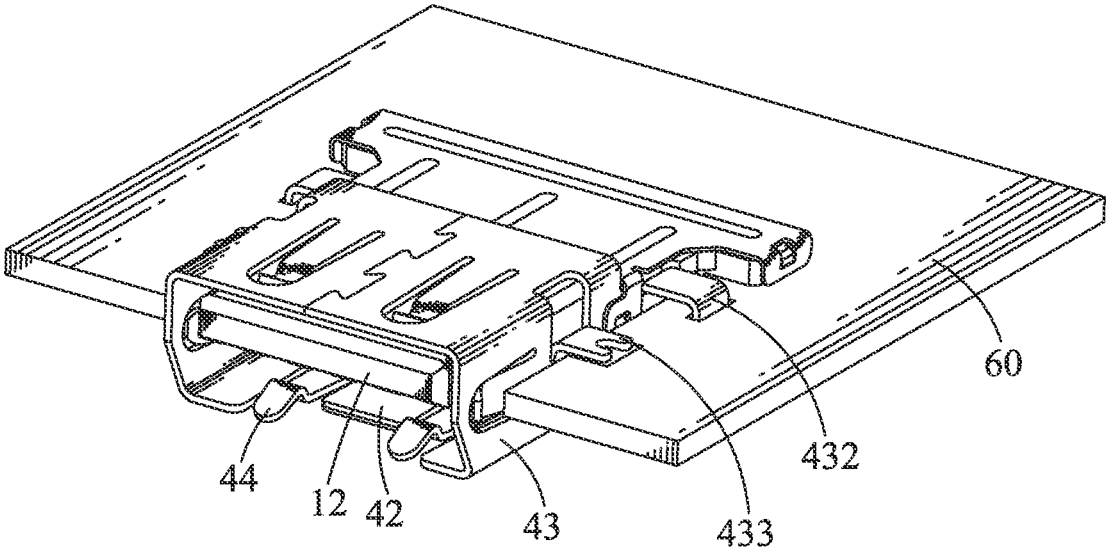
FIG. 1 is an assembled perspective view showing that an electrical connector is connected with a circuit board in accordance with an embodiment of the present invention.
Figure 2:
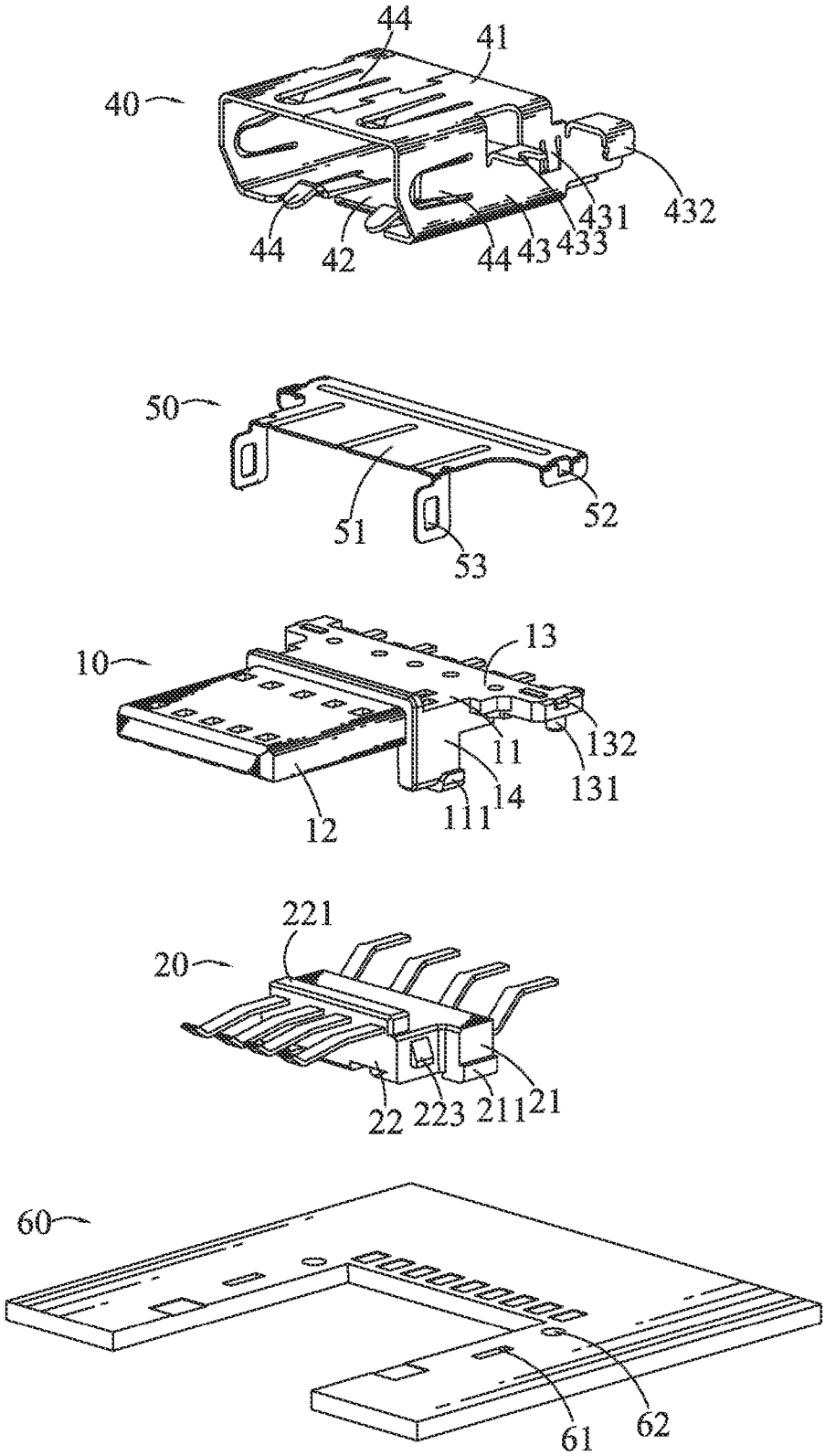
FIG. 2 and FIG. 3 are exploded perspective views of the electrical connector shown in FIG. 1.

Referring to FIG. 1 and FIG. 2, an electrical connector according to an embodiment of the present invention is connected with a circuit board 60. The electrical connector includes a first insulating housing 10, a second insulating housing 20, a terminal group 30, a metal shell 40 and a metal cover 50.

Figure 3:
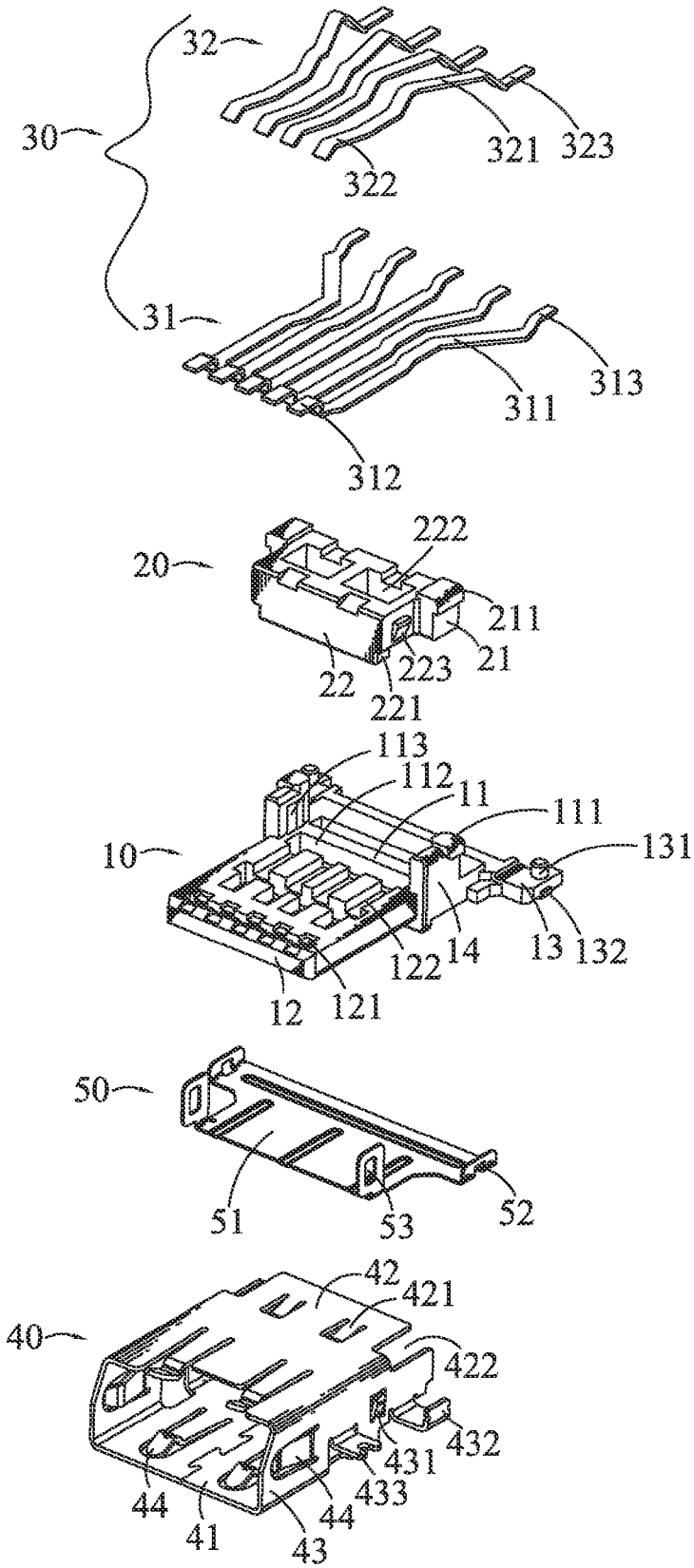
Figure 4:
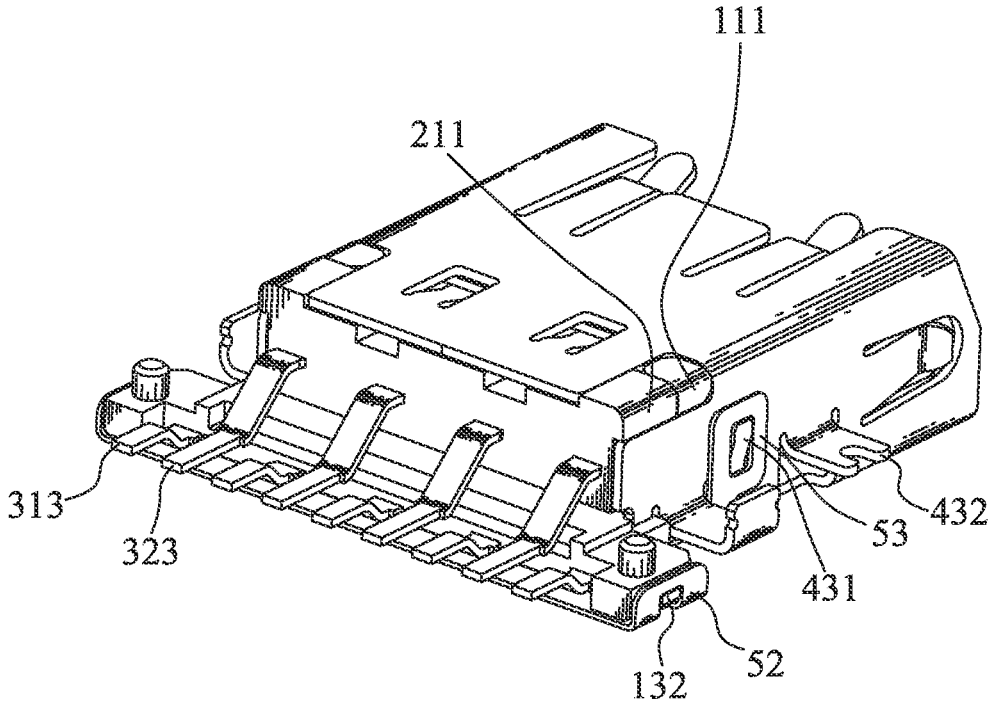
FIG. 4 is an assembled perspective view of the electrical connector of FIG. 1 viewed from another angle.

Referring to FIGS. 2-4, the first insulating housing 10 has a base board 11 and a tongue board 12 extending forwards from a front of the base board 11. Two opposite sides of the base board 11 extend downward to form a pair of clamping boards 14 spaced from each other. Bottom ends of the clamping boards 14 protrude downward and outward to form two first holding blocks 111. A bottom of the base board 11 defines a positioning groove 112. Two inner sides of the clamping boards 14 define a pair of fastening grooves 113. A front of a bottom of the tongue board 12 defines a plurality of first terminal grooves 121. A plurality of second terminal grooves 122 is opened in the bottom of the tongue board 12 and arranged behind the first terminal grooves 121, with each extending longitudinally. A top of a rear of the base board 11 extends rearward to form a propping board 13 with two sides thereof being further elongated sideward. The two elongated sides of the propping board 13 protrude downward to form a pair of insertion pillars 131. A pair of first buckling structures 132 is provided to the two elongated sides of the propping board 13.

The second insulating housing 20 is assembled to the first insulating housing 10, and has a base portion 21 resisting against rear edges of the clamping boards 14. A tongue portion 22 protrudes forwards from a front of the base portion 21 to be clamped between the clamping boards 14. Two opposite ends of a bottom of the base portion 21 protrude downward and outward to form two second holding blocks 211 of which each is in alignment with the corresponding first holding block 111 longitudinally. A top of the tongue portion 22 protrudes upward to form a positioning block 221 fastened in the positioning groove 112. A bottom of the second insulating housing 20 is concaved upward to form two blocking grooves 222. Two opposite sides of the tongue portion 22 oppositely protrude sideward to form two fastening wedges 223 buckled in the fastening grooves 113.

Referring to FIGS. 1-4, the terminal group 30 includes a plurality of flat terminals 31 and a plurality of spring terminals 32. Each flat terminal 31 has a first fastening strip 311, a first contact portion 312 and a first soldering tail 313 connected with a front end and a rear end of the first fastening strip 311 in a step manner respectively. The first fastening strips 311 are molded in the base board 11 and the tongue board 12 of the first insulating housing 10, wherein the one in the middle of the first fastening strips 311 is substantially of a straight strip shape and others are curved sideward away from the middle first fastening strip 311. The first contact portions 312 are exposed in the first terminal grooves 121 of the tongue board 12. The first soldering tails 313 project behind the first insulating housing 10. Each spring terminal 32 has a second fastening strip 321. A front end of the second fastening strip 321 is curved upward and then slantwise extends forward to form a second contact portion 322 of which a free end is arched downward. A second soldering tail 323 bends upward and then extends rearward from a rear end of the second fastening strip 321. The second fastening strips 321 are molded in the second insulating housing 20. The second contact portions 322 are received in the corresponding second terminal grooves 122 of the first insulating housing 10, with the free ends thereof elastically projecting beyond the bottom of the tongue board 12. The second soldering tails 323 project behind the first insulating housing 10 and are aligned with the first soldering tails 313 alternately in line to make the soldering tails 313, 323 of the terminal group 30 show a single-row layout for being soldered with the circuit board 60.

Referring to FIG. 2 and FIG. 3, the metal shell 40 encloses both the first insulating housing 10 and the second insulating housing 20. The metal shell 40 has a bottom plate 42, two side plates 43 and two top plates 41 engaged with each other. The top plates 41 of the metal shell 40 are shorter than the side plates 43 and the bottom plate 42 in length. Two sides of a rear of the bottom plate 42 are die-cut upward to form a pair of blocking slices 421 buckled in the blocking grooves 222 of the second insulating housing 20 respectively. The rear of the bottom plate 42 and rears of the two side plates 43 are disconnected with one another to define a pair of holding gaps 422 therebetween for respectively holding the first holding block 111 and the corresponding second holding block 211 therein. The rears of the side plates 43 are oppositely punched outward to form a pair of second buckling structures 431. Top edges of the rears of the side plates 43 oppositely extend outward and then bend downward to form a pair of soldering feet 432 of substantial inverted-L shape. The side plates 43 of the metal shell 40 are further die-cut outward to form a pair of flat soldering slices 433. The bottom plate 42, the side plates 43 and the top plates 41 of the metal shell 40 are die-cut inward to form a plurality of resisting arms 44.

Referring to FIGS. 2-4, the metal cover 50 has a flat cover plate 51. Two sides of a rear of the cover plate 51 are oppositely elongated sideward and then bent downward to form a pair of first locking structures 52. Two sides of a front of the cover plate 51 bend downward to define a pair of second locking structures 53. The cover plate 51 is covered on the base board 11 and the propping board 13 of the first insulating housing 10. The first locking structures 52 and the second locking structures 53 are buckled with the first buckling structures 132 and the second buckling structures 431 respectively to secure the metal cover 50, the metal shell 40 and the first insulating housing 10 together.

Referring to FIG. 1 and FIG. 2, the circuit board 60 defines a pair of soldering slots 61 and a pair of insertion holes 62. The electrical connector is embedded in the circuit board 60, with the soldering feet 432 of the metal shell 40 being inserted in the soldering slots 61 to be soldered with the circuit board 60, and the soldering slices 433 being soldered on the circuit board 60 respectively. The insertion pillars 131 of the first insulating housing 10 are inserted in the insertion holes 62 to secure the electrical connector and the circuit board 60 together.

As described above, the second soldering tails 323 of the spring terminals 32 project behind the first insulating housing 10 and are aligned with the first soldering tails 313 of the flat terminals 31 alternately in line to make the soldering tails 313, 323 of the terminal group 30 show a single-row layout, so it is convenience to solder the soldering tails 313, 323 with the circuit board 60 and further advantageous for a wiring layout of the circuit board 60.

What is claimed is:

1. An electrical connector adapted for connecting with a circuit board, comprising:

a first insulating housing having a base board and a tongue board extending forwards from a front of the base board, two opposite sides of the base board extending downward to form a pair of clamping boards spaced from each other;

a second insulating housing assembled to the first insulating housing, the second insulating housing having a base portion resisting against rear edges of the clamping boards, and a tongue portion protruding forwards from a front of the base portion to be clamped between the clamping boards;

a terminal group including a plurality of flat terminals and a plurality of spring terminals;

each flat terminal having a first fastening strip, a first contact portion and a first soldering tail connected with a front end and a rear end of the first fastening strip in a step manner respectively, the first fastening strips being molded in the base board and the tongue board of the first insulating housing, the first contact portions being exposed in a front of a bottom of the tongue board, the first soldering tails projecting behind the first insulating housing; and each spring terminal having a second fastening strip, a second contact portion which curves upward and then slantwise extends forward from a front end of the second fastening strip with a free end thereof arched downward, and a second soldering tail bending upward and then extending rearward from a rear end of the second fastening strip, the second fastening strips being molded in the second insulating housing, the second contact portions elastically projecting out of the bottom of the tongue board and being located behind the first contact portions, the second soldering tails projecting behind the first insulating housing and being aligned with the first soldering tails alternately in line to make the soldering tails of the terminal group show a single-row layout for being soldered with the circuit board; and a metal shell enclosing both the first insulating housing and the second insulating housing.

2. The electrical connector as claimed in claim 1, wherein the one in the middle of the first fastening strips is substantially of a straight strip shape and others are curved sideward away from the middle first fastening strip.

3. The electrical connector as claimed in claim 1, wherein a bottom of the base board defines a positioning groove, two inner sides of the clamping boards define a pair of fastening grooves, a top of the tongue portion protrudes upward to form a positioning block fastened in the positioning groove, two opposite sides of the tongue portion oppositely protrude sideward to form two fastening wedges buckled in the fastening grooves.

4. The electrical connector as claimed in claim 1, wherein the front of the bottom of the tongue board defines a plurality of first terminal grooves for exposing out the first contact portions therethrough, a plurality of second terminal grooves is opened in the bottom of the tongue board and arranged behind the first terminal grooves, each second terminal groove extends longitudinally for receiving the corresponding second contact portion therein.

5. The electrical connector as claimed in claim 1, wherein a bottom of the second insulating housing is concaved upward to form two blocking grooves, the metal shell has a bottom plate, two side plates and two top plates engaged with each other, two sides of a rear of the bottom plate are die-cut upward to form a pair of blocking slices buckled in the blocking grooves respectively.

6. The electrical connector as claimed in claim 5, wherein bottom ends of the clamping boards protrude downward and outward to form two first holding blocks, two opposite ends of the bottom of the base portion protrude downward and outward to form two second holding blocks of which each is in alignment with the corresponding first holding block longitudinally, the rear of the bottom plate and rears of the two side plates are disconnected with one another to define a pair of holding gaps therebetween for respectively holding the first holding block and the corresponding second holding block therein.

7. The electrical connector as claimed in claim 5, wherein the side plates of the metal shell are die-cut outward to form a pair of flat soldering slices, top edges of rears of the side plates oppositely extend outward and then bend downward to form a pair of soldering feet of substantial inverted-L shape, the circuit board defines a pair of soldering slots, the electrical connector is embedded in the circuit board with the soldering slices being soldered on the circuit board and the soldering feet being inserted in the soldering slots to be soldered with the circuit board.

8. The electrical connector as claimed in claim 5, wherein the bottom plate, the side plates and the top plates of the metal shell are die-cut inward to form a plurality of resisting arms.

9. The electrical connector as claimed in claim 5, further comprising a metal cover having a cover plate, two sides of a rear of the cover plate are oppositely elongated sideward and then bent downward to form a pair of first locking structures, two sides of a front of the cover plate bend downward to define a pair of second locking structures, a top of a rear of the base board extends rearward to form a propping board with two sides thereof being further elongated sideward, a pair of first buckling structures are provided to the two elongated sides of the propping board, the top plates of the metal shell are shorter than the side plates and the bottom plate in length, the rears of the side plates are oppositely punched outward to form a pair of second buckling structures, the cover plate is covered on the base board and the propping board, the first and the second locking structures are buckled with the first and the second buckling structures respectively.

10. The electrical connector as claimed in claim 9, wherein the two elongated sides of the propping board protrude downward to form a pair of insertion pillars, the circuit board defines a pair of insertion holes, the electrical connector is embedded in the circuit board with the insertion pillars being inserted in the insertion holes respectively.

* * * * *